US007833376B2

(12) United States Patent
Schmidt

(10) Patent No.: US 7,833,376 B2
(45) Date of Patent: Nov. 16, 2010

(54) APPARATUS AND METHOD FOR MANUFACTURING CORRUGATED BOARDS

(75) Inventor: Stephen R. Schmidt, Indiana Head Park, IL (US)

(73) Assignee: Copar Corporation, Burbank, IL (US)

( * ) Notice: Subject to any disclaimer, the term of this patent is extended or adjusted under 35 U.S.C. 154(b) by 603 days.

(21) Appl. No.: 11/558,741

(22) Filed: Nov. 10, 2006

(65) Prior Publication Data

US 2007/0084543 A1 Apr. 19, 2007

Related U.S. Application Data

(62) Division of application No. 09/961,126, filed on Sep. 21, 2001, now abandoned.

(51) Int. Cl.
*B31F 1/28* (2006.01)

(52) U.S. Cl. ..... 156/205; 156/208

(58) Field of Classification Search ..... 156/205, 156/208

See application file for complete search history.

(56) References Cited

U.S. PATENT DOCUMENTS

| | | | | |
|---|---|---|---|---|
| 1,199,508 | A | 9/1916 | Swift, Jr. | |
| 1,796,542 | A | 3/1931 | Schoo | |
| 2,674,299 | A | 4/1954 | Bruker | 154/31 |
| 2,751,964 | A | 6/1956 | Guyer | 154/33.05 |
| 3,077,222 | A | 2/1963 | Shanley | 156/473 |
| 3,189,502 | A | 6/1965 | Little | 156/210 |
| 3,383,234 | A | 5/1968 | Nikkel | 117/37 |
| 3,434,901 | A | 3/1969 | Griffiths et al. | 156/210 |
| 3,536,561 | A | 10/1970 | Griffiths | 156/205 |
| 3,690,981 | A | 9/1972 | Frank et al. | 156/210 |
| 3,864,185 | A | 2/1975 | Johnson et al. | 156/208 |
| 3,922,129 | A | 11/1975 | McDonald | 425/135 |
| 4,140,564 | A | 2/1979 | Schrader | 156/205 |
| 4,278,486 | A | 7/1981 | Schrader | 156/231 |
| 4,419,173 | A | 12/1983 | Akiyama et al. | 156/470 |
| 4,655,870 | A | 4/1987 | Mori et al. | 156/285 |
| 4,765,855 | A | 8/1988 | Geoffroy-Dechaume et al. | 156/205 |

(Continued)

FOREIGN PATENT DOCUMENTS

| | | |
|---|---|---|
| DE | 901 255 | 1/1954 |

(Continued)

OTHER PUBLICATIONS

PQ Corporation, MSDS (Material Safety Data Sheet) Sodium Silicate Solution; date prepared on Jun. 13, 2006.*

(Continued)

*Primary Examiner*—John L Goff
*Assistant Examiner*—Jaeyun Lee
(74) *Attorney, Agent, or Firm*—Marshall, Gerstein & Borun LLP

(57) ABSTRACT

A method and an apparatus for manufacturing corrugated boards are disclosed. The method may include the steps of supplying a first web of medium having a first and second sides, wherein each side of the first web having a plurality of flutes, and wherein each flute having a crest, applying a wetting agent and an adhesive composition in a sequential fashion to the plurality of flutes on the first side of the first web, and securing a second web of medium is to the plurality of crests on the first side of the first web to form a single-faced corrugated board.

17 Claims, 4 Drawing Sheets

U.S. PATENT DOCUMENTS

| | | | | |
|---|---|---|---|---|
| 4,806,183 | A | 2/1989 | Williams | 156/64 |
| 4,871,406 | A | 10/1989 | Griffith | 156/82 |
| 5,275,657 | A | 1/1994 | Duffy et al. | 118/224 |
| 5,292,391 | A | 3/1994 | Wallick | 156/205 |
| 5,332,458 | A | 7/1994 | Wallick | 156/210 |
| 5,348,610 | A | 9/1994 | McKinlay et al. | 156/472 |
| 5,609,711 | A | 3/1997 | Miller | 156/292 |
| 5,676,790 | A | 10/1997 | Burrows | 156/353 |
| 5,846,376 | A | 12/1998 | Gossett et al. | 156/356 |
| 6,089,296 | A | 7/2000 | Hess et al. | 156/462 |
| 6,126,771 | A | 10/2000 | Mosburger et al. | 156/205 |
| 6,153,037 | A | 11/2000 | Kim et al. | 156/205 |
| 6,171,427 | B1 | 1/2001 | Hess et al. | 156/208 |
| 6,827,784 | B1 | 12/2004 | Kern | 118/693 |
| 2002/0071937 | A1 | 6/2002 | Smith et al. | 428/182 |
| 2005/0170148 | A1 | 8/2005 | Mattila et al. | 428/174 |

FOREIGN PATENT DOCUMENTS

| | | | |
|---|---|---|---|
| EP | 0 936 059 | | 8/1999 |
| EP | 0 951 998 | | 10/1999 |
| JP | 05177748 A | * | 7/1993 |
| WO | WO 97/15440 | | 5/1997 |

OTHER PUBLICATIONS

C. Cox, *Corrugator Major Components: Maintenance and Operating Guidelines*, Tappi Press, Atlanta, pp. 1-84 1993.

*Corrugated Board Manufacture: Training Manual*, British Fibreboard Packaging Association.

*Glossary of flexographic terms*, Tappi Press, Atlanta, pp. 1-27 1992.

* cited by examiner

APPARATUS AND METHOD FOR MANUFACTURING CORRUGATED BOARDS

CROSS REFERENCE TO RELATED APPLICATION

The present application is a divisional patent application of U.S. patent application Ser. No. 09/961,126 filed on Sep. 21, 2001, the specification of which is expressly incorporated by reference herein.

FIELD OF INVENTION

The invention generally relates to corrugated boards and, more particularly, relates to apparatus and method for manufacturing corrugated boards.

BACKGROUND OF THE INVENTION

Conventional corrugators produce single-faced, double-backed and multiple-wall corrugated boards by bonding papers together. Typically, an adhesive is applied to the surfaces of crests of the corrugated portion of the papers. In particular, a starch slurry is prepared as one of ordinary skill in the art will readily recognize using mainly powdered starch and water. Borax and caustic soda may also be added during the preparation of the starch slurry. The prepared starch slurry is often pumped into a reservoir or a pan and applied to flute tips (i.e., crests) of a web of fluting paper by an application roll. A turning doctor roll regulates the thickness of the starch slurry on the application roll to apply to the web of fluting paper, which is typically heated by a corrugating roll. A web of liner paper engages the web of fluting paper at the flute tips such that the starch slurry is absorbed into the web of liner paper as the fluting paper and the liner paper are firmly pressed together. The starch slurry is gelled by the application of heat from the corrugating roll and secures the flute tips onto the liner paper. In particular, during the cooking process, the granules of the powdered starch absorb water, burst, gelatinize and form a glue. The moisture in the glue then evaporates or is absorbed into the liner paper and the glue bonds the liner paper and the flute tips of the fluting paper together.

As one of ordinary skill in the art will readily recognize, the amount of the adhesive required to bond the liner paper with the flute tips of a fluting paper may vary based on the speed of the corrugating process. In particular, more adhesive is required in a corrugating process that operates at a lower speed. However, if the process is operating at a rate that is too slow, virtually all of the water from the starch slurry is absorbed after the slurry is applied to the flute tips and prior to the slurry becoming an adhesive. As a result, no bonds are formed between the liner paper and the flute tips of the fluting paper. Accordingly, more starch slurry is required in the process to simply serve as a carrier of water in order to ensure sufficient amount of water remains in the slurry to form the adhesive.

Further, the inventor has found that as the starch slurry is applied to a dry flute tip provided on a heated, fluted roller, the water of the slurry may be carried through the flute by capillary action at an undesirably fast pace and the starch may effectively dry on the flute. Typically, water from the starch slurry is absorbed into the fluting paper after the slurry is applied and before the slurry becomes an adhesive. Such a phenomenon has at least two negative implications. The first is that the percentage of unusable starch may be sufficient to degrade the effective adhesive quality of the slurry, thereby producing less than optimum product. The second is that manufacturers are required to compensate for this contingency by applying more starch to the flutes than would ordinarily be received to produce an effective bond, thereby reducing efficiency and increasing cost. It would therefore be advantageous to apply the starch slurry to the flute tips of the corrugated paper in a more efficient and effective manner. In particular, it would be advantageous to reduce the amount of starch slurry applied to the flute crests and accordingly reduce the cost of producing corrugated boards, while at the same time maintaining or improving bond quality.

SUMMARY OF THE INVENTION

In accordance with one aspect of the invention, a method for manufacturing corrugated boards is provided, which comprises the steps of supplying a first web of medium having a first and second sides with a plurality of flutes on each side and each flute having a crest, supplying a second web of medium, applying a wetting agent to the crests on the first side of the first web, applying an adhesive composition to the crests on the first side of the first web, and securing the second web to the crests on the first side of the first web to form a single-faced corrugated board.

In accordance with another aspect of the invention, an apparatus for manufacturing corrugated boards is provided, which comprises a corrugating device, a wetting device, an adhesive supply device and a securing device. The corrugating device is adapted to form a plurality of flutes on a first and second sides of a first web of medium. Each of the plurality of flutes includes a crest. The wetting device is adapted to apply a wetting agent to a plurality of crests on the first side of the first web. The adhesive supply device is adapted to apply an adhesive composition to the plurality of crests on the first side of the first web. The securing device is adapted to secure a second web of medium to the plurality of crests on the first side of the first web to form a single-faced corrugated board.

In accordance with another aspect of the invention, an apparatus for manufacturing corrugated boards is provided, which comprises first and second corrugated rolls rotationally engaged to each other, first and second wetting rolls disposed for rotation in a first reservoir, first and second adhesive rolls disposed for rotation in a second reservoir and a securing roll disposed to rotationally engage the first corrugated roll.

In accordance with another aspect of the invention, a corrugated article manufactured according to the steps comprising supplying a first web of medium having a first and second sides with a plurality of flutes on each side and each flute having a crest, supplying a second web of medium, applying a wetting agent to a plurality of crests on the first side of the first web, applying an adhesive composition to the plurality of crests on the first side of the first web, and securing the second web to the plurality of crests on the first side of the first web to form a single-faced corrugated board.

These and other aspects and features of the invention will become apparent from the following detailed description when taken in conjunction with the accompanying drawings.

Figure 1:
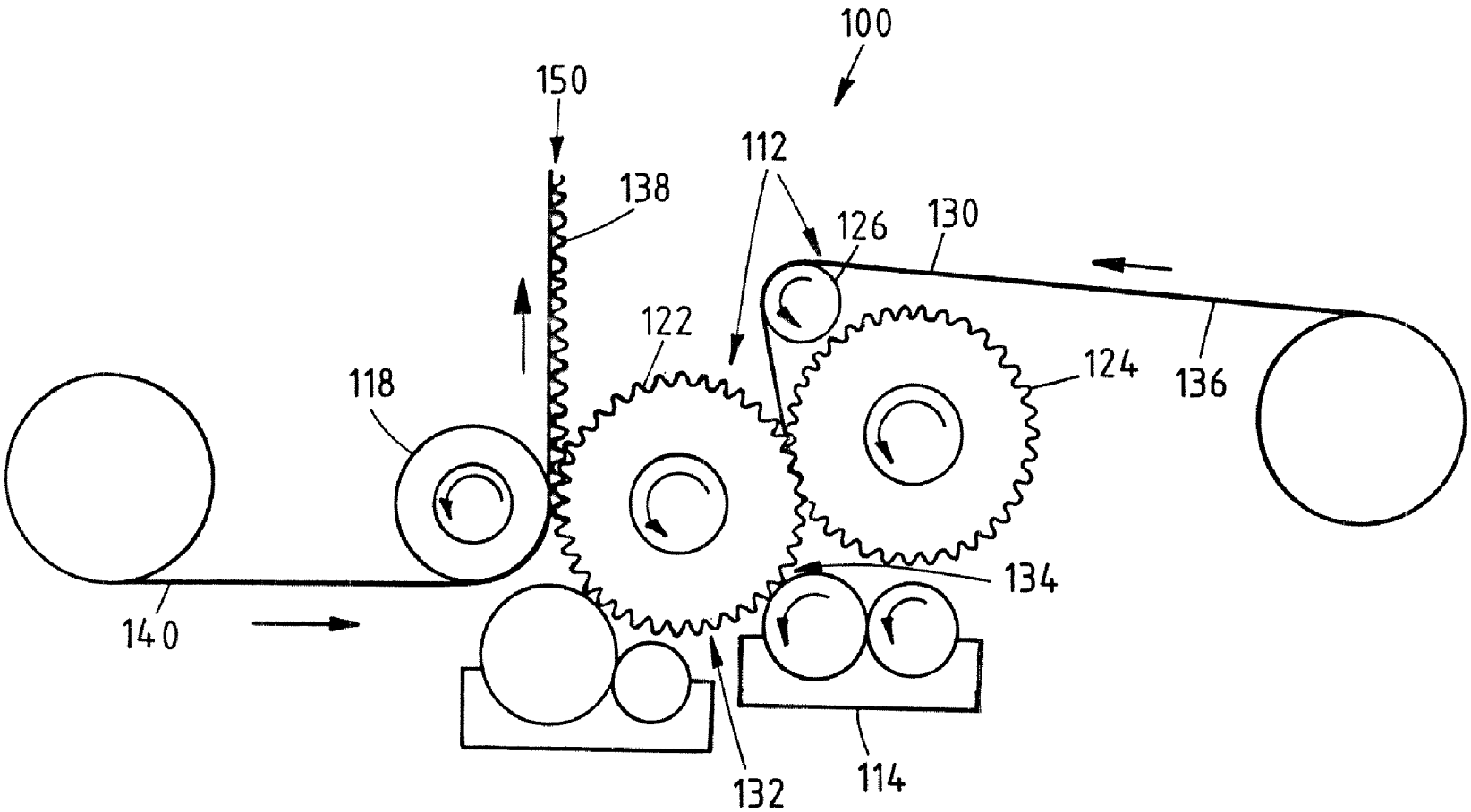
FIG. 1 is a cross-sectional view of a single-faced corrugator constructed in accordance with teachings of the invention.

While the invention is susceptible to various modifications and alternative constructions, certain illustrative embodiments thereof have been shown in the drawings and will be described below in detail, it should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Referring now to the drawings, and with specific reference to FIG. 1, a corrugator constructed in accordance with the teachings of the invention is generally referred to by reference numeral 100. As shown therein, the corrugator 100 generally includes a corrugating device 112, a wetting device 114, an adhesive supply device 116, and a securing device 118. The corrugating device 112 includes a first component 122 and a second component 124, which may be, but are not limited to, corrugating rolls. In particular, each of the corrugating rolls includes a plurality of matting grooves with the depth, spacing, and shape of the grooves varying based on the intended purpose of the end product, i.e., the corrugated board. A first web of medium 130 is supplied to the first and second components 122, 124 of the corrugating device 112 as one of ordinary skill in the art will readily recognize. For example, a support roll 126 may used to support and supply the first web of medium 130 into the corrugating device 112. The first and second components 122, 124 are rotationally engaged such that a plurality of flutes 132 may be formed on a first web of medium 130. The plurality of flutes 132 may be a continuous series of generally sinusoidally shaped waves on the first web of medium 130, which may be, but is not limited to, fluting paper. Each of the plurality of flutes 132 on the first web of medium includes a crest (one generally shown as 134 in FIG. 1). The first component 122 of the corrugating device 112 may retain the first web of medium 130 by a mechanical device, a vacuum, or pressure applied to the first web of medium 130. In particular, the first web of medium 130 is disposed between the first component 122 of the corrugating device 112 and the wetting device 114 such that the wetting device 114 engages the crests of the plurality of flutes 132 on a first side 136 of the first web of medium 130.

Figure 2:
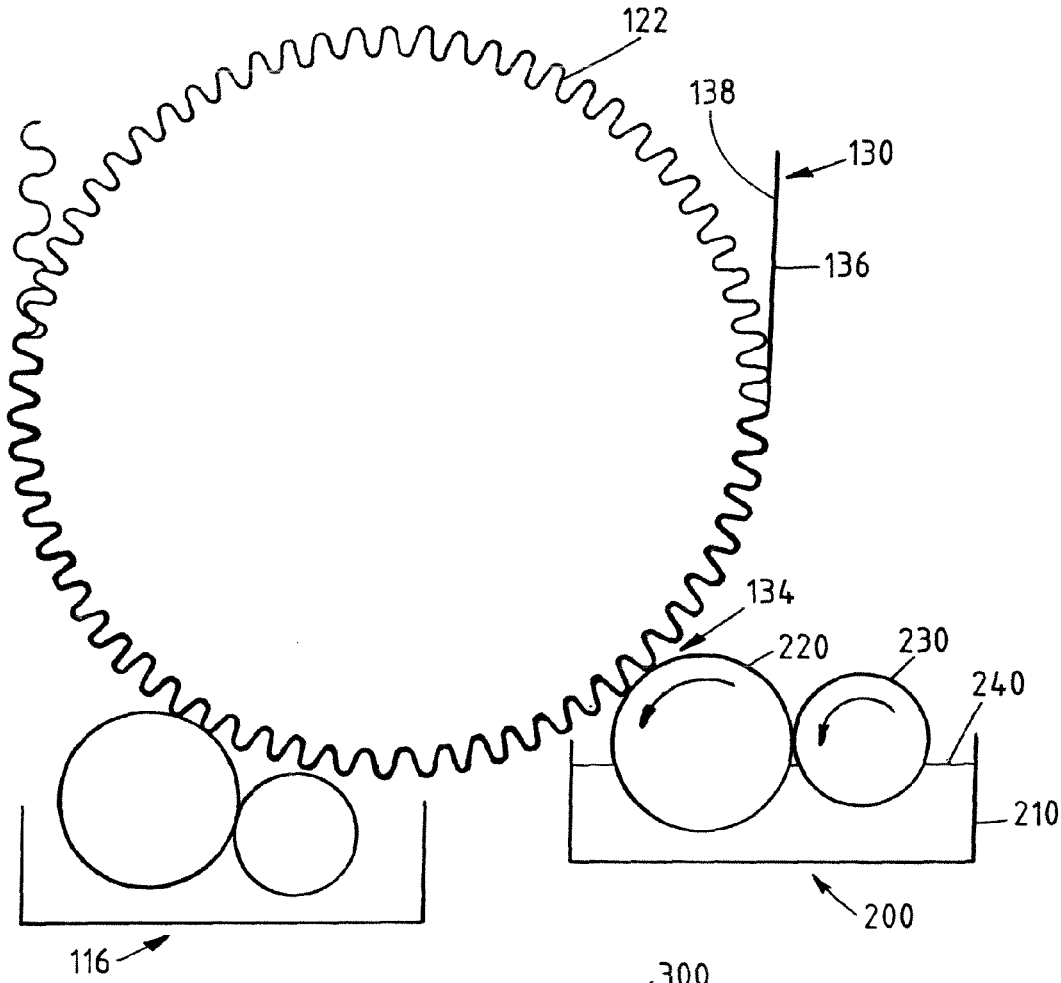
FIG. 2 is a cross-sectional view of a wetting device constructed in accordance with teachings of the invention.
Figure 3:
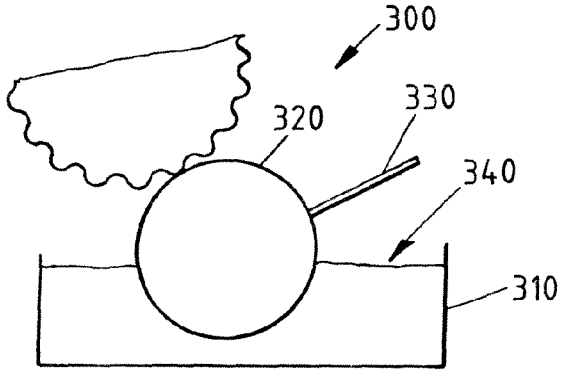
FIG. 3, is a cross-sectional view of an alternate embodiment of the wetting device constructed in accordance with teachings of the invention.

Accordingly, the wetting device 114 does not engage a second side 138 of the first web of medium 130. In this part of the process, the wetting device 114 may be, but is not limited to, an anilox system (as shown in FIGS. 2 and 3, and further described in detail below) a system of rollers, a sprayer, a rod coater and a belt system. The wetting device 114 applies a wetting agent to the crests of the plurality of flutes 132 on the first web of medium 130 to reduce the amount of adhesive composition needed to be applied to the crests.

As the first component 122 of the corrugating device 112 continues to retain the first web of medium 130, the adhesive supply device 116 applies an adhesive composition to the crests of the plurality of flutes 132 on the first web of medium 130. Similar to the wetting device 114, the adhesive supply device 116 also engages the crests of the plurality of flutes 132 on the first side 136 of the first web of medium 130. In particular, the adhesive supply device 116 may be, but is not limited to, an anilox system (as shown in FIGS. 2 and 3, and further described in detail below) a roller system and any other adhesive application system as known in the art.

Further, the securing device 118 is disposed to secure a second web of medium 140 to the crests of the plurality of flutes 132 on the first side 136 of the first web of medium 130 to form a single-faced corrugated board 150. The securing device 118 may be, but is not limited to, a heat application device such as a pressure roll and a belt, or simply paper tension.

It is to be understood that the above materials and dimensions are provided for the purpose of disclosing the currently known best mode for practicing the teachings of the invention, and should not be construed as limiting in any manner.

As noted above, the wetting device 114 may be, but is not limited to, an anilox system, a sprayer (i.e., masked to spray at the crests only), a rod coater, and a belt system. For example, as shown in FIG. 2, the wetting device 114 may be an anilox system 200 that generally includes a storage device 210, a first roll 220 and a second roll 230. The storage device 210 may be, but is not limited to, a pan and a reservoir adapted to contain a wetting agent 240 such as water. The first and second rolls 220, 230 are rotationally engaged to apply the wetting agent 240 to the crests (e.g., crest 134) on the first side 136 of the first web 130. For example, both the first and second rolls 220, 230 rotate counter-clockwise to apply the wetting agent 240 to the crest 134. The second roll 230 is adapted to remove excess wetting agent 240 on the first roll 220. Further, the anilox system 200 may also be adapted to implement the adhesive supply device 116. For example, the first roll 220 may be adapted to apply an adhesive composition to the crest 134 and the second roll 230 may be adapted to remove excess amount of the adhesive composition on the first roll 220. The adhesive composition may be, but is not limited to, a starch composition and a water-based adhesive composition such as a poly vinyl acetate. For example, the starch composition may be a starch slurry produced from maize starch, wheat starch, potato starch, tapioca and other vegetable starch.

In an alternate embodiment, the wetting device 114 may be an anilox system 300 as shown in FIG. 3. The anilox system 300 generally includes a storage device 310, an applicator roll 320 and a doctor blade 330. The storage device 310 may be, but is not limited to, a pan and a reservoir adapted to contain a wetting agent 340 such as water. The applicator roll 320 provides water to the crests of the plurality of flutes 132 on the first web 130. The doctor blade 330 removes excess water from the applicator roll 320. Further, the adhesive supply device 116 may also be the anilox system 300 as described above. In yet another alternate embodiment, the wetting device 114 may be, but is not limited to, a sprayer with a moving aperture to limit spray to the flute tops only, a rod coater, and a belt system as one of ordinary skill in the art will readily recognize.

Figure 4:
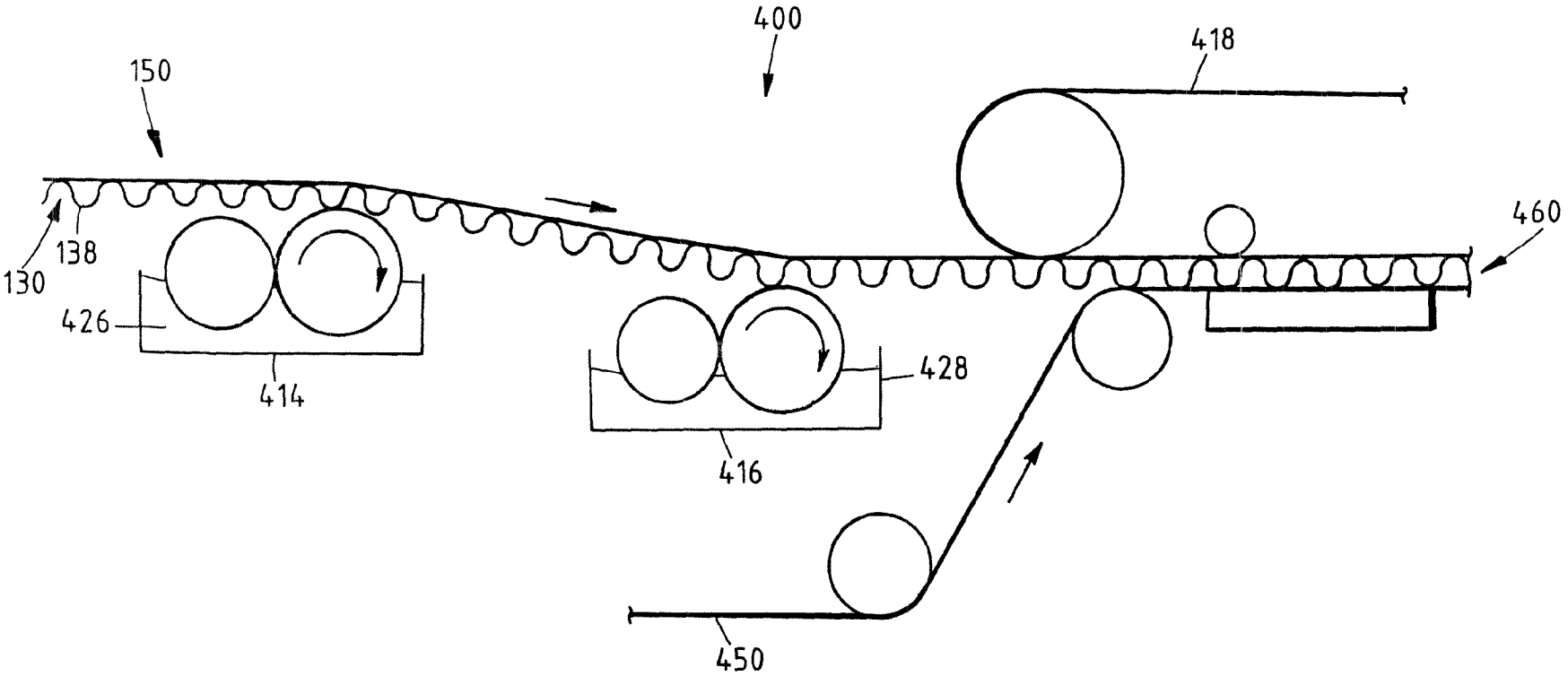
FIG. 4 is a cross-sectional view of a double-backed corrugator constructed in accordance with teachings of the invention.

The wetting device 114 and the adhesive supply device 116 may also be used with a double-backer corrugator to form double-backed corrugated boards. Referring to FIG. 4, the double-backer corrugator 400 generally includes a wetting device 414, an adhesive supply device 416 and a securing device 418. The wetting device 414 and the adhesive supply device 416 may be, for example, the anilox systems as shown in FIGS. 2 and 3. The wetting device 414, for example, may apply a wetting agent 426 to the single-faced corrugated board 150. In particular, the wetting agent 426 is applied to the crests of the plurality of flutes 132 on the second side 138 of the first web 130 at a predetermined rate, which may be, but is not limited to, a constant rate and a variable rate. Further, the adhesive supply device 416 applies an adhesive composition 428 to the crests of the plurality of flutes 132 on the second side 138 of the first web 130 after the wetting device 416 applied the wetting agent 426. A third web of medium 450, which may be, but is not limited to, liner paper, is supplied to the securing device 418. In particular, the third web of medium 450 is bonded to the single-faced corrugated board 150 at the crests of the plurality of flutes 132 on the second side 138 of the first web 130. Accordingly, the third web of medium 450 and the single-faced corrugated board 150 form a double-backed corrugated board 460. It is to be further understood that the teachings of the invention can be employed in manufacturing multiple-wall corrugated boards having more than two single-faced corrugated boards and in manufacturing solid fiber boards without the plurality of flutes.

Figure 5:
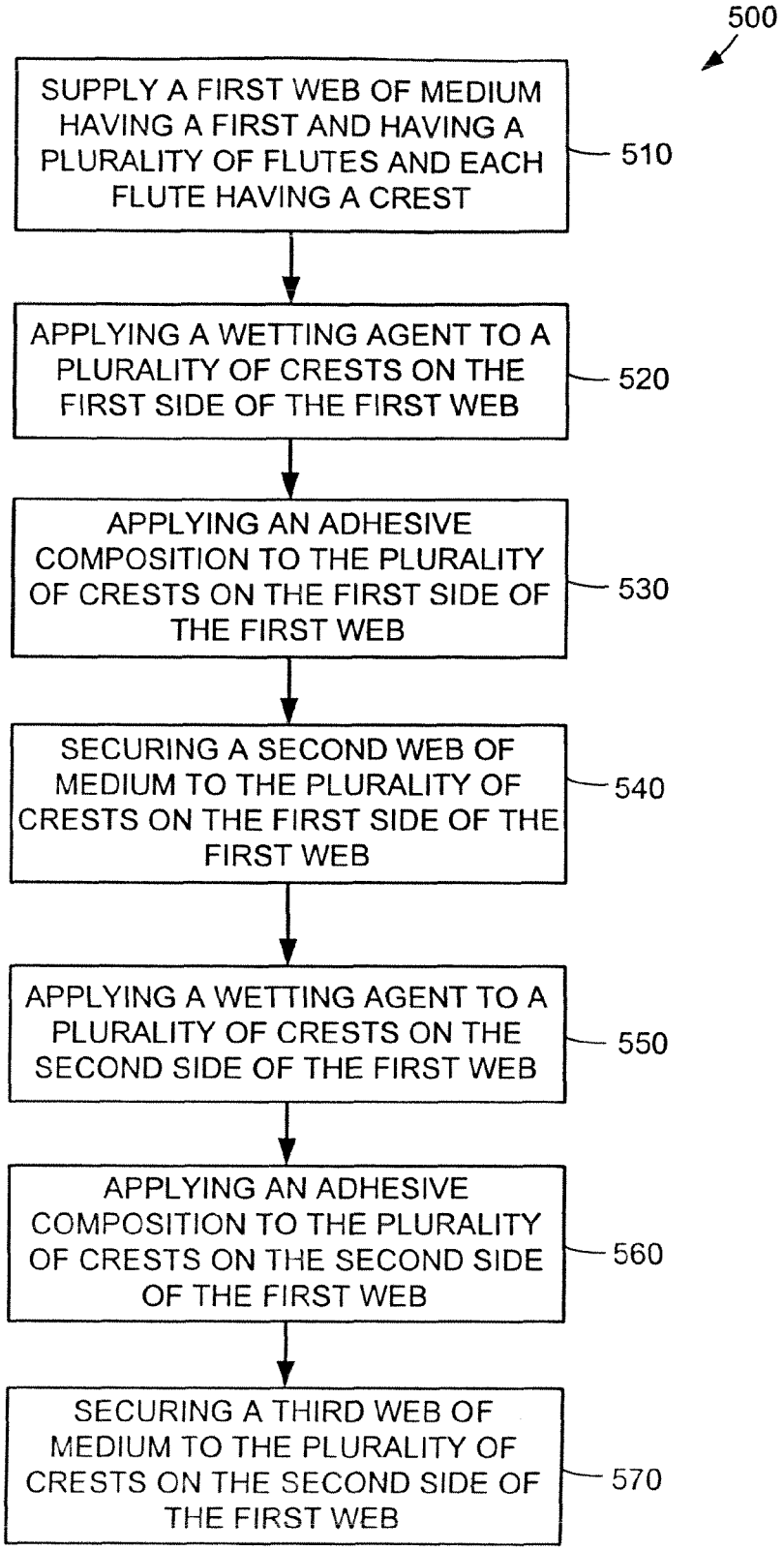
FIG. 5 is a flow chart depicting a sequence of steps used in conjunction with the method according to the teachings of the invention.

Referring now to FIG. 5, the flow chart thereof depicts a sequence of steps 500 which may be taken in accordance with the teachings of the invention to manufacture corrugated boards. As shown therein, a first step 510 thereof is supplying a first web of medium having a first and second sides. The first web of medium is prepared as one of ordinary skill in the art will readily recognize. A plurality of flutes are formed on the first web of medium such that each of the plurality of flutes includes a crest.

At a step 520, a wetting agent such as water with or without additives is applied to a plurality of crests on the first side of the first web. At a step 530, an adhesive composition such as a starch slurry is applied to the plurality of crests on the first side of the first web after the wetting agent is applied at step 520. The adhesive composition such as starch slurry is prepared as one of ordinary skill in the art will readily recognize. For example, the starch slurry may be heated to a temperature such that the powdered starch granules burst, gelatinize, and form a glue.

At a step 540, a second web of medium, which is also prepared as one of ordinary skill in the art will readily recognize, is secured to the plurality of crests on the first side of the first web using the adhesive composition. Accordingly, a single-faced corrugated board is formed by bonding the second web of medium and the plurality of crests on the first side of the first web of medium. A wetting agent may then be applied to the plurality of crests on the second side of the first web as indicated by a step 550.

At a step 560, an adhesive composition is applied to the crests on the second side of the first web after the wetting agent is applied at step a 550. At a step 570, a third web of medium is secured to the crests on the second side of the first web using the adhesive composition. Accordingly, the third web of medium and the single-faced corrugated board are bonded to form a double-backed corrugated board.

Further, the sequence of steps as described above may be repeated to manufacture additional layers to the double-backed corrugated board. For example, a single-faced corrugated board is manufactured from step 510 through step 530 so that the single-faced corrugated board may be secured to either the second or the third web of medium to form a multiple-wall corrugated board.

From the foregoing, one of ordinary skill in the art will appreciate that the invention provides a method for manufacturing corrugated board and an apparatus for accomplishing same.

What is claimed:

1. A method for manufacturing a corrugated board, comprising:

supplying a first web having a first side and a second side, each side of the first web having a plurality of flutes, and each flute having a crest;

supplying a second web;

applying a wetting agent to only the crests of the flutes on the first side of the first web to moisten the plurality of crests; wherein the wetting agent consists essentially of water applying an adhesive composition to the plurality of crests on the first side of the first web; and securing the second web to the plurality of crests on the first side of the first web to form a single-faced corrugated board.

2. The method of claim 1, wherein applying the wetting agent to only the crests on the first side of the first web comprises applying the wetting agent to the crests on the first side of the first web at a predetermined rate, and wherein the predetermined rate comprises one of a constant rate and a variable rate.

3. The method of claim 1, wherein applying the wetting agent to only the crests on the first side of the first web comprises applying a wetting agent to the plurality of crests on the first side of the first web prior to applying the adhesive composition to the plurality of crests on the first side of the first web.

4. The method of claim 1, wherein applying the wetting agent to only the crests on the first side of the first web comprises using a first water supply device to apply the wetting agent to the crests on the first side of the first web, and wherein the first water supply device comprises one of an anilox system, a sprayer, a plurality of rollers, a rod coater, and a belt system.

5. The method of claim 1, wherein applying the adhesive composition to the plurality of crests on the first side of the first web comprises applying one of a starch composition and a water-based adhesive composition to the plurality of crests on the first side of the first web.

6. The method of claim 1, wherein applying the adhesive composition to the plurality of crests on the first side of the first web comprises applying the adhesive composition after applying the wetting agent to the plurality of crests on the first side of the first web, and wherein the adhesive composition comprises one of maize starch, wheat starch, potato starch, and tapioca.

7. The method of claim 1 further comprising:

supplying the single-faced corrugated board;

supplying a third web;

applying the wetting agent to only the crests on the second side of the first web of the single-faced corrugated board to moisten the plurality of crests;

applying the adhesive composition to the plurality of crests on the second side of the first web of the single-faced corrugated board; and securing the third web to the plurality of crests on the second side of the first web of the single-faced corrugated board to form a double-backed corrugated board.

8. The method of claim 7, wherein applying the wetting agent to only the crests on the second side of the first web of the single-faced corrugated board comprises applying the wetting agent to the plurality of crests on the second side of the first web of the single-faced corrugated board prior to applying the adhesive composition to the plurality of crests on the second side of the first web of the single-faced corrugated board.

9. The method of claim 7, wherein applying the wetting agent to only the crests on the second side of the first web of the single-faced corrugated board comprises using a second water supply device to apply the wetting agent to the plurality of crests on the second side of the first web of the single-faced corrugated board, and wherein the second wetting device comprises one of an anilox system, a sprayer, a plurality of rollers, a rod coater, and a belt system.

10. A method of manufacturing a corrugated board comprising:

supplying a first web having a first side and a second side;

corrugating the first web to include a plurality flutes on each side thereof, each flute having a crest;

supplying a second web;

applying a wetting agent to only the crests of the flutes on the first side of the first web to moisten the plurality of crests; wherein the wetting agent consists essentially of water applying an adhesive composition to the plurality of crests on the first side of the first web; and securing the second web to the plurality of crests on the first side of the first web to form a single-faced corrugated board.

11. The method of claim 10, wherein the wetting agent substantially comprises water.

12. The method of claim 10, wherein the wetting agent is applied prior to applying the adhesive composition.

13. The method of claim 10, wherein applying the adhesive composition comprises applying a starch composition to the plurality of crests on the first side of the first web.

14. The method of claim 13, wherein the starch composition is selected from the group consisting of maize starch, wheat starch, potato starch, and tapioca.

15. The method of claim 10, wherein applying the wetting agent to only the crests on the first side of the first web comprises applying the wetting agent to the plurality of crests on the first side of the first web at a predetermined rate, wherein the predetermined rate is any one of a constant rate and a variable rate.

16. The method of claim 10, wherein applying the wetting agent to only the crests on the first side of the first web comprises using any one of an anilox system, a sprayer, a plurality of rollers, a rod coater, and a belt system.

17. The method of claim 10, further comprising:

supplying a third web;

applying the wetting agent to only the crests on the second side of the first web;

applying the adhesive composition to the plurality of crests on the second side of the first web; and securing the third web to the plurality of crests on the second side of the first web.

* * * * *